US009021928B2

(12) United States Patent
Schleehauf

(10) Patent No.: US 9,021,928 B2
(45) Date of Patent: May 5, 2015

(54) LATHE ACCESSORY FOR BAND SAW

(76) Inventor: Martin W. Schleehauf, Duquesne, PA (US)

( * ) Notice: Subject to any disclaimer, the term of this patent is extended or adjusted under 35 U.S.C. 154(b) by 653 days.

(21) Appl. No.: 13/432,125

(22) Filed: Mar. 28, 2012

(65) Prior Publication Data

US 2013/0000782 A1 Jan. 3, 2013

Related U.S. Application Data

(60) Provisional application No. 61/501,915, filed on Jun. 28, 2011.

(51) Int. Cl.

| | |
|---|---|
| ***B27C 7/04*** | (2006.01) |
| ***B27C 7/00*** | (2006.01) |
| *B27C 7/06* | (2006.01) |

(52) U.S. Cl.

CPC ..... *B27C 7/00* (2013.01)

(58) Field of Classification Search

USPC ..... 142/2, 52, 55, 56; 82/113, 152, 157, 82/162

See application file for complete search history.

(56) References Cited

U.S. PATENT DOCUMENTS

| | | | | | |
|---|---|---|---|---|---|
| 1,061,411 | A * | 5/1913 | Schulte | 142/55 |
| 1,706,178 | A * | 3/1929 | Mattison | 142/55 |
| 2,769,466 | A * | 11/1956 | Brauneis | 142/7 |
| 2,880,767 | A * | 4/1959 | Rodgers | 142/55 |
| 3,304,969 | A * | 2/1967 | MacDougall | 144/35.1 |
| 4,256,155 | A * | 3/1981 | Hochstatter et al. | 142/7 |
| 4,899,795 | A * | 2/1990 | Hackett | 144/138 |
| 5,065,802 | A * | 11/1991 | Peterson | 144/2.1 |
| 5,503,200 | A * | 4/1996 | Lea | 142/38 |
| 2013/0000782 | A1 * | 1/2013 | Schleehauf | 142/1 |

* cited by examiner

*Primary Examiner* — Will Fridie, Jr.
(74) *Attorney, Agent, or Firm* — McKay & Associates, P.C.

(57) ABSTRACT

A lathe accessory for a band saw including a foundation assembly adapted to attach to a table for the band saw. A translating layer assembly engages the foundation assembly and is permitted to move thereon. A carriage assembly is disposed on the translating layer, the carriage assembly further comprising a frame subassembly and a bulkhead subassembly, the frame subassembly further comprising an endwall adapted to support a left end of a workplace, and a front frame rail and back frame rail both connected to a frame leg to thereby slidably connect the frame subassembly to the translating layer. The bulkhead subassembly forms the other side of the carriage to secure the other end of the workpiece. Internal components within the bulkhead motorize the bulkhead, such that the workpiece can be turned and manipulated in two dimensions as the bandsaw blade cuts the rotating workpiece.

20 Claims, 10 Drawing Sheets

LATHE ACCESSORY FOR BAND SAW

CROSS-REFERENCE TO RELATED APPLICATIONS

The instant application claims benefit of provisional application Ser. No. 61/501,915 filed Jun. 28, 2011, the contents of which are incorporated herein by reference.

BACKGROUND

1. Field of the Invention

The instant invention relates to an accessory for a bandsaw wherein the bandsaw coupled with the accessory is capable of functioning as a wood, lathe, the lathe accessory being a small, portable device that can be attached to the table of the bandsaw.

2. Description of the Related Art

As is known in the art a lathe is a machine tool, which, by rotating a workpiece on its axis, can perform various operations. By cutting, sanding, knurling, or drilling, these tools are applied to the workpiece to create an object which has symmetry about an axis of rotation. Used in woodturning, metalworking, metal spinning, and glass-working, lathes can be used to shape a variety of articles such as chess pieces, furniture legs, and ornamental objects such as candlesticks and bowls.

Furthermore, multi-purpose tools having a lathe function can be adapted to produce variably-shaped works of metal or wood as is are known in the art. For example, U.S. Pat. No. 6,293,320 to McGregor, II is a multi-purpose machining apparatus which includes a motor, a grip means, and a guide. U.S. Patent Pub. 2007/0089804 to Vincent is a lathe apparatus. U.S. Pat. No. 4,899,795 to Hackett reveals a guide (bed plate) which engages a saw table and is slidable thereon in a fore-and-aft direction relative to the saw blade.

Most lathes, especially modern lathes, are complex and expensive, not efficiently usable by the hobbyist. The blade mechanisms present on these devices further add to the complexity and cost. There is a need then for a lathe accessory which is a small and portable and that can be easily attached to the table of a bandsaw, thereby giving the bandsaw the ability to function as a wood lathe in a cost-effective, user-friendly manner.

SUMMARY

Figure 1:
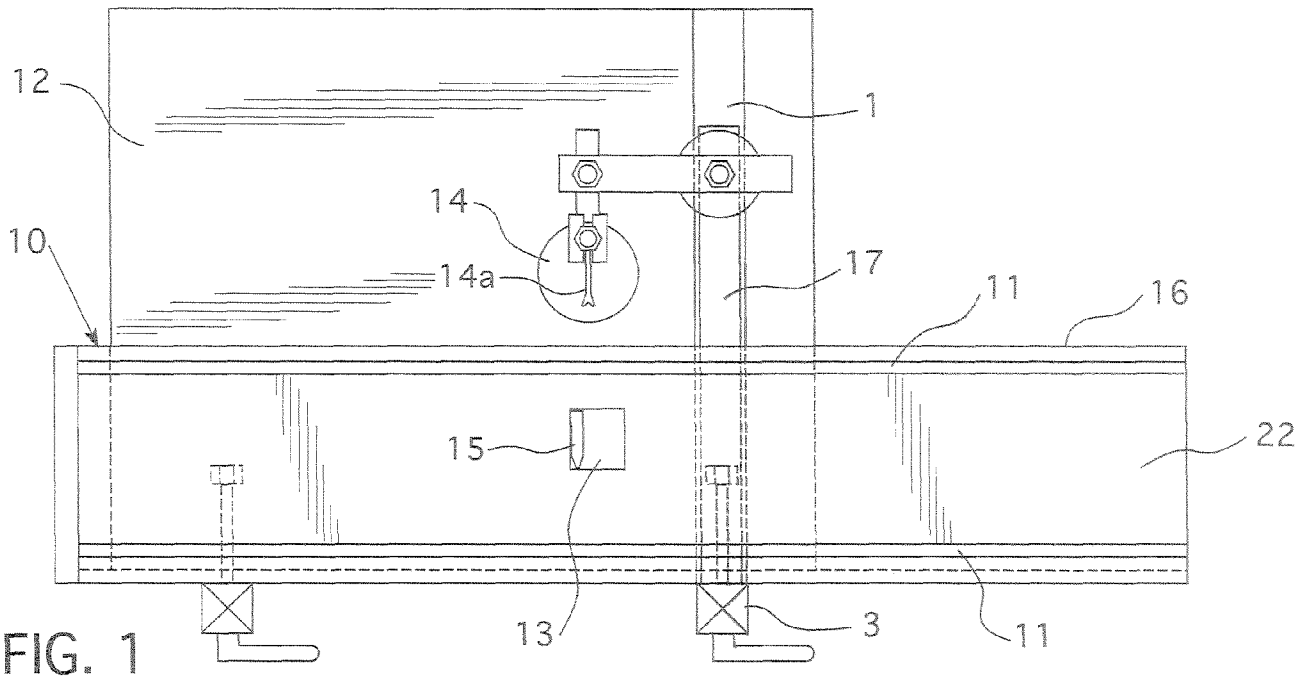
FIG. 1 shows a top plan view of the foundation, assembly as attached to the bandsaw table.
Figure 1A:
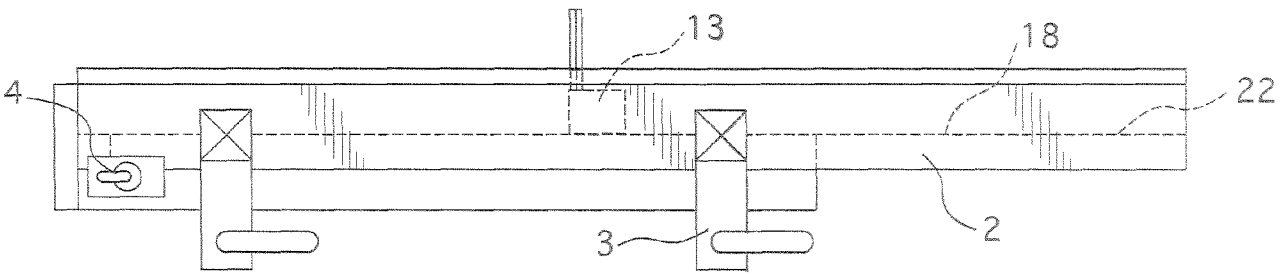
FIG. 1A shows a front elevation view of the foundation, assembly as attached to the bandsaw table.

The instant lathe accessory ("device") is a small, portable device that can be attached to the table of a bandsaw, thereby giving the bandsaw the ability to function as a wood lathe. The action (power) required to remove material from the workplace is provided entirely by the bandsaw itself, thus allowing wood to be removed in a more controlled manner than with a conventional wood lathe. The device acts as a means for precisely holding and moving the workpiece relative to the bandsaw blade.

A workpiece is turned within a workspace defined by a carriage and frame. Turning involves rotating the workpiece on its axis, and as the carriage moves both left/right and forward/backward the bandsaw removes material, thus giving the workpiece axial (rotational) symmetry. The axis of rotation is oriented in the horizontal (left/right) direction, for example about 4" above the bandsaw table. The device uses a pattern ("template") that can be made by the operator, or otherwise made available, beforehand. Templates range from uniform, e.g., for turning dowel rod; to tapered, e.g., for turning pegs; to detailed, e.g., for turning chess pieces, decorative posts, etc. The operator moves the carriage and therefore the workpiece as guided by the template, thus transferring the profile of the template to the workpiece.

More specifically, the invention comprehends a lathe accessory for a band saw, comprising a foundation assembly adapted to attach to a table for the band saw, the foundation assembly having a pair of long edges with one of the long edges configured to overhang the table, and further comprising a pair of foundation rails inward from the long edges and traveling a length of the foundation assembly. A stylus base is disposed on the bottom surface, and a stylus is attached to the stylus base upstanding therefrom. A ridge on the bottom surface extends downward therefrom, the ridge configured to fit into a tool guide groove of the band saw table. Next, a translating layer assembly engages the foundation assembly, the translating layer assembly having a top, an underside, a left half, and a right half, and further comprising a pair of grooves defined within the underside, each groove shaped to mate with a respective one of the foundation rails. Further included on the translating layer is a pair of translating rails on the top and a slot defined within the left half permitting movement of the translating layer without interference with the stylus. Then a carriage assembly is disposed on the translating layer, the carriage assembly further comprising a frame subassembly and a bulkhead subassembly, the frame subassembly further comprising an endwall adapted to support a left end of a workpiece. A template platform extends from the endwall, and a front frame rail extends from the endwall spaced from the template platform defined over the slot. A back frame rail extends from the endwall opposite both the template platform and the front frame rail, and a frame leg perpendicular to the back frame rail opposite the endwall connects the front frame rail and the back frame rail and is slidably disposed over one of the translating rails, wherein the front frame rail and the back frame rail are both connected to the frame leg to thereby slidably connect the frame subassembly to the translating layer.

The bulkhead subassembly has a bulkhead bottom conforming to the frame leg, a housing, an outside bulkhead wall, and an inside bulkhead wall, thereby defining a workspace between the endwall and the bulkhead subassembly. Internal components within the interior of the bulkhead motorize the bulkhead and also a fixturing assembly, so in this manner the workpiece can be turned within the workspace while providing a means for further manipulating the workpiece in two dimensions (left/right and forward/backward) as the bandsaw blade cuts the rotating workpiece.

DETAILED DESCRIPTION OF THE PREFERRED EMBODIMENT

The figures described herein and shown relate to one embodiment which is used with a DELTA® 10" band saw, which has a height clearance of 6.75" across its entire 10-inch throat depth. Deducting one inch for the endwall thickness (at left end of device), and doubling the result, yields a maximum workpiece length of 18" that can be accommodated by the device, in this the preferred embodiment only. The device shown can accommodate a maximum workpiece diameter of 3.5". Use with other band saw makes and models is possible, as well as with drill presses in conjunction with a rasp bit. (An adapter plate would be needed for use with a drill press.) "Band saw" as herein defined, refers to either a band saw or a drill press. Devices that can accommodate workpiece diameters up to 6" are also possible. By interposing itself between the operator and the band saw (or drill press), the device provides an additional safety buffer for the operator. Accordingly, described herein is but one, preferred, embodiment, as follows.

The device consists of primarily three separate layers, or assemblies, namely the foundation assembly 10, translating layer assembly 20, and carriage assembly 30. Generally, the carriage assembly 30 holds the workpiece 50 in a fixture and allows it to rotate about an axis as needed within a workspace 314. The foundation assembly 10 supports the carriage while being attached to the band saw table 12, with an intermediary translating layer assembly 20 allowing the carriage to move about the foundation 10. This system constrains the axis of rotation to remain parallel to the front of the band saw table 12, while allowing the operator to move the workpiece 50 left, right, forward, and backward, as needed.

Therefore, with reference to FIG. 1, a foundation assembly 10 is adapted to attach to a table 12 for the band saw 14, the foundation assembly 10 having a pair of long edges 16 with one of the long edges 16 configured to overhang (overhang 2) the table 12 and bottom surface 18. Two clamps and an adjustment screw act as a clamp means 3 to enable the foundation assembly 10 to be quickly and reproducibly fastened to the band saw table 12. A ridge 17 on the bottom surface 18 of the foundation 10 fits into the tool guide groove 1 that is a standard feature in all band saw tables 12. The right-hand clamp presses upward against the underside of the tool-guide groove 1. The left-hand clamp presses upward against the underside of the left edge of the band saw table 12 (each a means for clamping). Together, the clamps keep the foundation from sliding on the band saw table 12 and the left end from lifting. A pair of foundation rails 11 is inward from the long edges 16 and travels a length of the foundation assembly 10. Therefore, as shown, the foundation assembly 10, or bottommost layer of the device, is clamped to the band saw table 12 and has foundation rails 11 to allow the translating layer (as further described) to slide left and right. The foundation assembly 10 preferably extends beyond the band saw table 12 in both directions.

A stylus 15 is attached to the top surface 22 of the foundation 10 and is used to follow the contour of a template, which is held in the carriage, thus guiding the blade 14*a* to remove material from the workpiece 50 as further described. When assembled, the stylus 15 protrudes through a slot 25 in the translating layer and can make contact with the template in the carriage. More particularly, a stylus base 13 is disposed on the bottom surface 18, and a stylus 15 attached to the stylus base 13 upstands therefrom. In the preferred embodiment the stylus 15 is a thin metal beam (⅛"*½") that is deep in the forward/backward direction to minimize deflection while allowing it to follow deep contours in the template. The front edge of the stylus 15. i.e., the edge that makes contact with the template, has a sufficiently small radius to permit detailed duplication of the pattern on the template. Although not critical, the radius of the front edge of the stylus 15 should not be smaller than about 0.01" to avoid damaging the template. (There is little benefit of making the radius of the front edge of the stylus 15 smaller than 0.01" since the band saw blade 14*a* is about 1/32" thick, which limits the level of detail that can be duplicated.)

Figure 2:
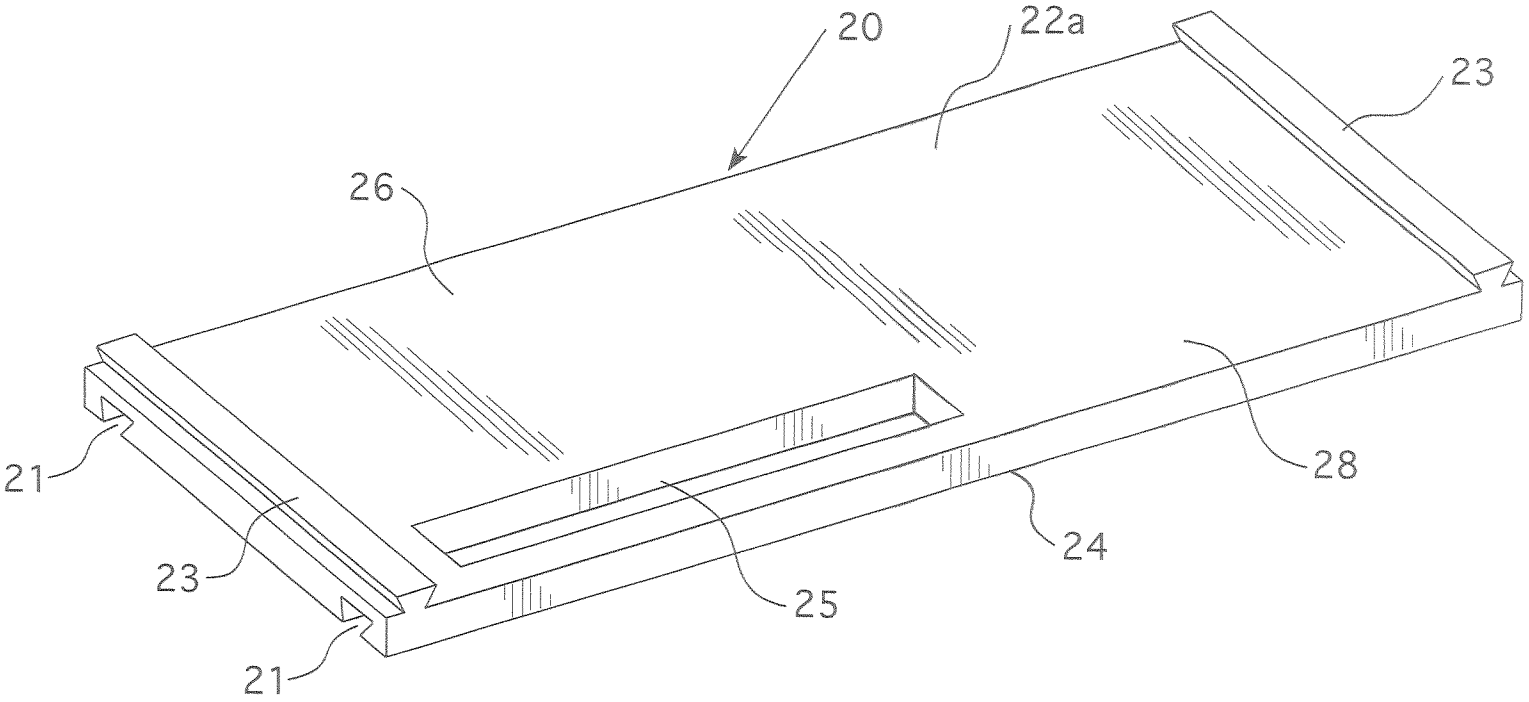
FIG. 2 shows a perspective view of the translating layer which attaches to the foundation and forms the base of the carriage.

With reference to FIG. 2, shown is the translating layer assembly 20 which engages the foundation assembly 10. The bottom of the translating layer 20 contains grooves 21 that mate with the foundation rails 11. Specifically, the translating layer assembly 20 engages the foundation assembly 10, the translating layer assembly 20 having a top 22*a*, an underside 24, a left half 26, and a right half 28. A pair of grooves 21 is defined within the underside 24, each groove 21 shaped to mate with a respective one of the foundation rails 11. A pair of translating rails 23 on the top 22*a* is oriented front to hack, and a slot 25 is defined within the left half 26 permitting movement of the translating layer without interference with the stylus 15.

Figure 3:
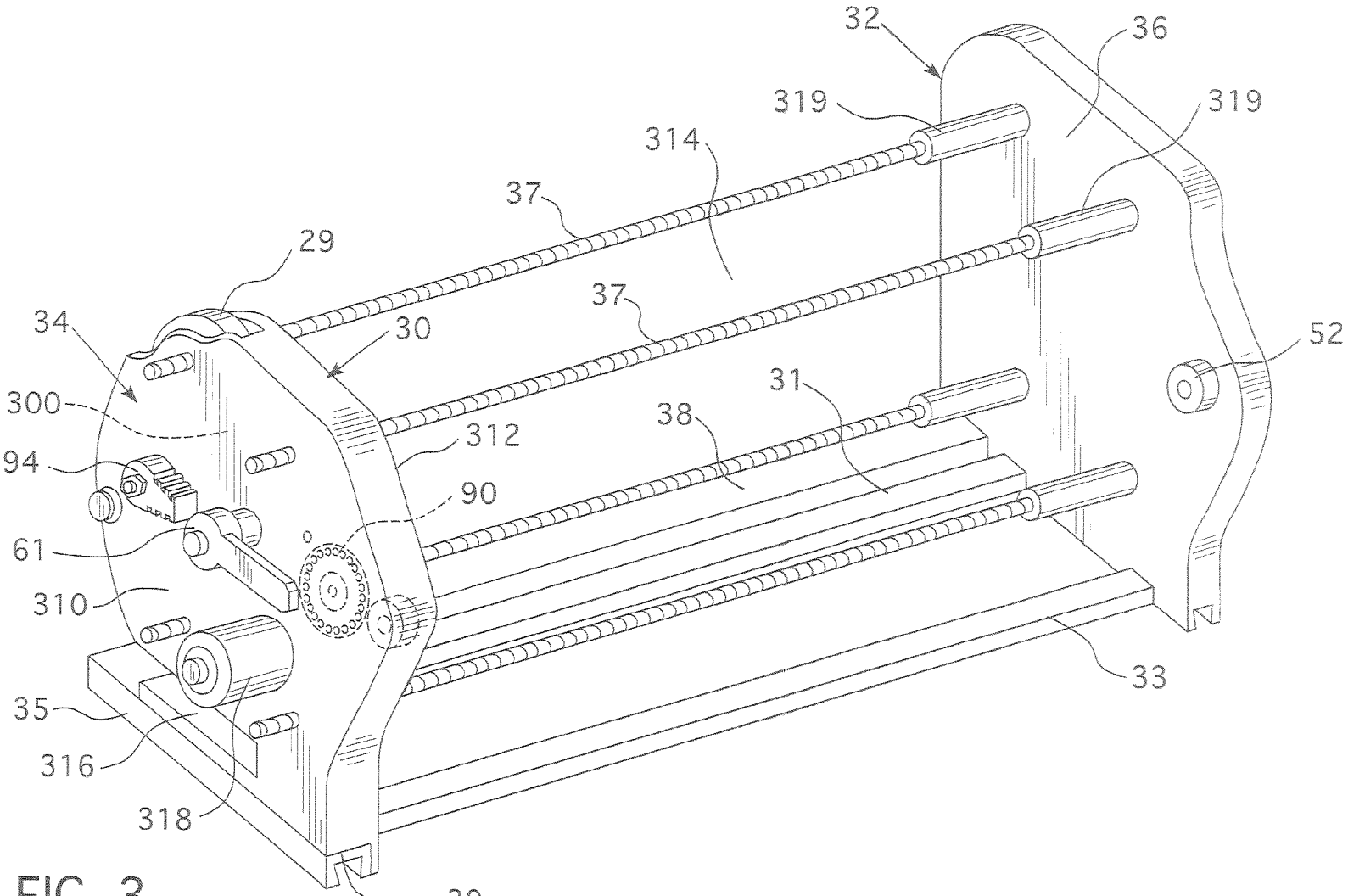
FIG. 3 is a perspective view of the carriage which defines the workspace for the workpiece.
Figure 5:
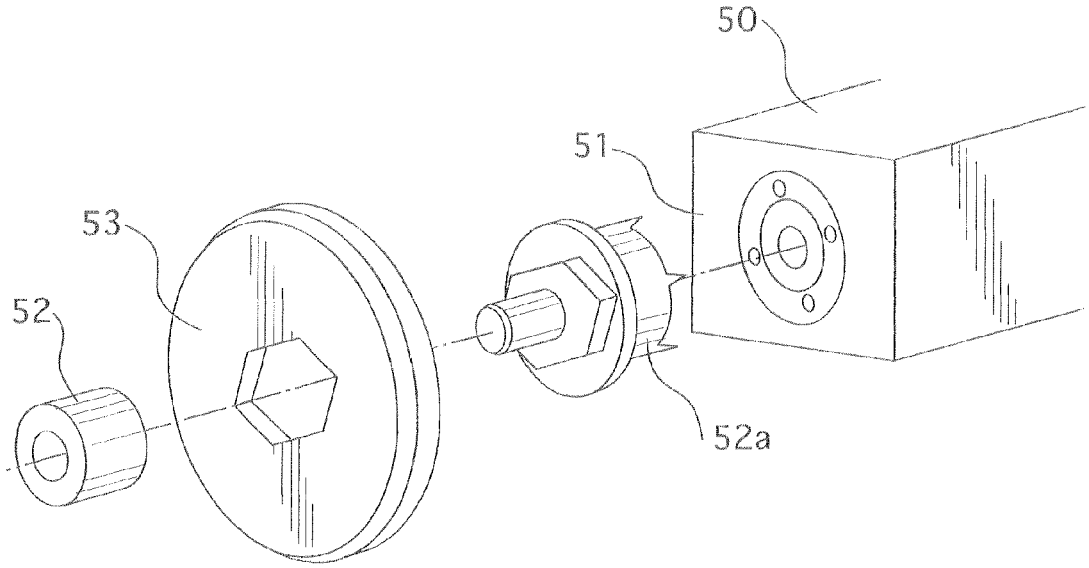
FIG. 5 is an exploded view of the fixturing system which fixes the workpiece within the workspace.

The carriage assembly 30 shown in FIG. 3 engages the translating layer assembly 20. In summary, the carriage assembly 30 consists of a frame subassembly 32 that slides forward/backward over the translating layer 20, and a bulkhead, subassembly 34 (thick wall) that can move left/right within the frame 32. The bulkhead subassembly 34 supports the right end 51 of the workpiece 50 (FIG. 5), while the endwall 36 (part of frame) supports the left end (not shown) of the workpiece 50 (FIG. 5). More specifically, the carriage assembly 30 is disposed on the translating layer assembly 20 and further comprises a frame subassembly 32 and a bulkhead subassembly 34. The frame subassembly 32 includes an endwall 36 adapted to support a left end (not shown) of a workpiece 50 and a template platform 38 extending from the endwall 36. A front frame rail 31 extends from the endwall 36 spaced from the template platform 38 defined over the slot 25. A back frame rail 33 extends from the endwall 36 opposite both the template platform 38 and the front frame rail 31. A frame leg 35 perpendicular to the back frame rail 33 opposite the endwall 36 connects the front frame rail 31 and the back frame rail 33 and is slidably disposed over one of the translating rails 23, wherein the front frame rail 31 and the back frame rail 33 are both connected to the frame leg 35 to thereby slidably connect the frame subassembly 32 to the translating layer assembly 20. Multiple threaded rods 37 rigidly attached to the endwall 36 extend the length of the frame subassembly 32 traveling through the bulkhead subassembly 34, which threaded rods 37 may further include a means for limiting a proximity of the bulkhead subassembly 34 with the endwall 36 of the frame subassembly 32, shown here as plastic sleeve stops 319. The threaded rods 37 pass through the threaded centers of four sprockets 40 within the bulkhead, which are synchronized by a chain 42.

As will be further described, using a motor 318 to turn the sprockets 40 thus causes the bulkhead subassembly 34 to move left and right to allow quick fixturing and release of the workpiece 50 (FIG. 5). The sprockets 40 can be turned either manually, using a thumbwheel 29, or electrically, using the motor 318 mounted to the bulkhead subassembly 34. The motor 318 is also used to turn the workpiece 50. The motor 318 is used to quickly move the bulkhead subassembly 34 large distances, while the thumbwheel 29 is used for making fine adjustments in position, or to apply additional torque, if needed, to release the workpiece 50. The operator controls how and when the motor 318 is used, by means of a double-throw double-pole (DTDP) switch 4, contacts within the selector assembly 60, an electro-mechanical interlock (safety) 94, and push button. When in the locked position, a brake shoe presses against the thumbwheel 29, to ensure that the bulkhead does not move during turning. These are all components which make up the bulkhead subassembly 34.

Figure 4:
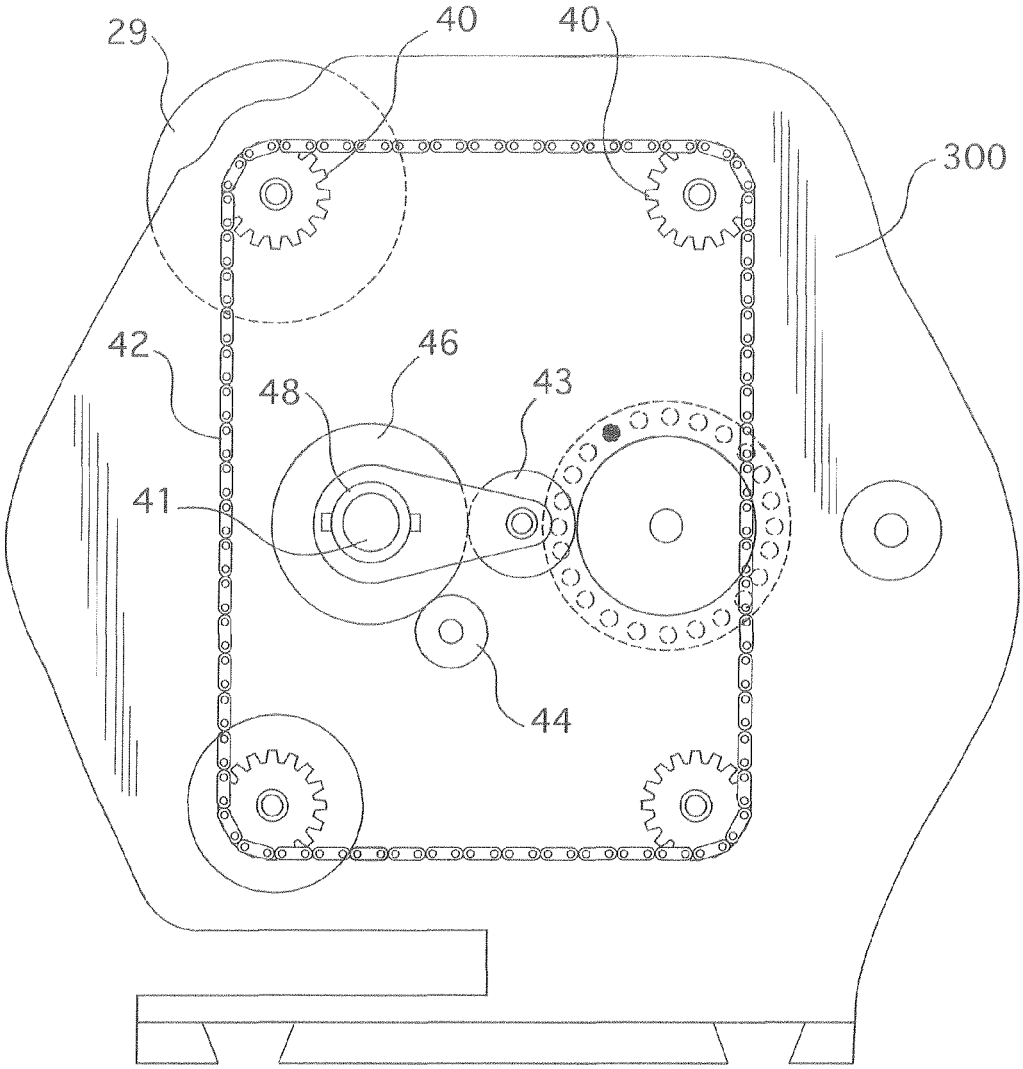
FIG. 4 shows an interior view of the bulkhead subassembly, which is a component of the carriage (FIG. 3).

Referencing FIG. 4 with continued, reference to FIG. 3, the bulkhead subassembly 34 has a bulkhead bottom 39 conforming to the frame leg 35, a housing 300, an outside bulkhead wall 310, and an inside bulkhead wall 312, thereby defining the workspace 314 between the endwall 36 and the bulkhead subassembly 34. The bulkhead subassembly 34 includes a notch 316 defined at the bulkhead bottom 39 fitting over the front frame rail 31. Multiple sprockets 40 disposed within the housing 300 each have a center through which each threaded rod 37 passes, as above. A chain 42 within the housing 300 engages and synchronizes each sprocket 40.

As above, the motor 318 is mounted on the outside bulkhead wall 310 for turning the sprockets 40, the motor 318 including a motor pinion 44 housed within the housing 300. Inside the bulkhead, the motor 318 pinion 44 engages the bull gear 46 (part of the selector assembly 60 (FIG. 6)). The bull gear 46 drives a pinion at the end of the selector assembly 60, and the position of the selector assembly 60 determines whether this pinion delivers power to the drive chain 42 (via a gear that is coupled to one of the sprockets 40) or the external pinion 92 (for turning). During turning operations, the primary purpose of the motor 318 is to rotate the workpiece 50 (FIG. 5) so that the entire circumference is exposed to the band saw blade 14*a* (FIG. 1). The preferred direction of rotation of the workpiece 50 where it contacts the band saw blade 14*a* is downward, i.e., in the same direction as the band saw blade 14*a*. The motor 318 also acts to prevent the workpiece 50 from spinning too quickly in the event that the band saw blade 14*a* exerts a strong tangential force to a portion of the workpiece 50. Limiting the rate of rotation of the workpiece 50 allows the band saw 14 to remove material as intended, and also limits centrifugal forces, which could cause excessive vibration and loosening of the workpiece 50, especially while it is still unbalanced.

In the preferred embodiment, the motor 318 and gearing rotate at 400 rpm, corresponding to a downward tangential velocity of about 5 ft/sec at a workpiece 50 radius of 3". This is about 10% of the downward velocity of the saw blade 14*a*. This rate of rotation is great enough to expose the entire circumference of the workpiece 50 to the band saw blade 14*a* in a seemingly continuous manner to the operator, while maintaining a sufficiently high relative cutting speed on the workpiece 50. This supports allowing the operator to (slowly) move the translating layer horizontally while at a fixed (shallow) depth of cut, so as to reduce the turned diameter one thin layer at a time. The power source for the device shown is an external (12 VDC) battery, although alternatively the device could be powered by an onboard battery pack.

Referencing FIG. 5, the bulkhead subassembly 34 also contains a fixturing bearing 52 for fixturing the workpiece 50, by allowing insertion of the grip/removable gear 53 assembly. The centerline of the bearing extends beyond the backmost edge of the back frame rail 33, to enable the band saw 14 to cut all the way down to the axis of rotation of the workpiece 50 without contacting any part of the device. A notch 316 at the base of the bulkhead allows it to clear a template up to 3" deep. As built, the device can accommodate a workpiece 50 up to 3.5" in diameter, but a more optimal arrangement could probably accommodate workpieces up to 6" in diameter. The workpiece 50 can be inserted into bearings 52 in the bulkhead subassembly 34 and end wall 36 by using two fixturing grips 52*a*, one of which is embedded into a shallow (3/32" deep) circular groove at each end of the workpiece 50. Each grip 52*a* consists of the following four (4) pieces that have been brazed together: a round (1/4" diameter) shaft that extends the entire length of the grip; a short (3/16") section of hollow round steel (3/4" outside diameter); an oversized washer, which serves as an annular seating surface for the workpiece 50 as well as for the removable gear 53 (when used); and a flat, hexagonal "nut" for engaging the removable gear 53 (when used). One end of the shaft helps to center the grip by entering the hole created by the centering drill bit of the fixturing hole saw; and the other end enters the hole in the bearing 52. The length of the hollow round steed, includes four, evenly spaced (3/32" long) teeth, which protrude into the workpiece 50. The depth of engagement of the teeth into the workpiece 50 is limited by the oversized washer, which also ensures that the grip is oriented perpendicular to and seated firmly against the end surface of the workpiece 50. The hexagonal nut region is slightly thinner than the removable gear 53. This ensures that, when, installed, the removable gear 53 is held in place by a compressive force applied between bearings. A hole saw (3/4" outside diameter, 1/4" center drill) is used to cut a 3/32" deep circular groove into each end of the workpiece 50 to accommodate the fixturing grip 52*a*. Each fixturing grip 52*a* fits into a fixturing grip holder to allow it to be driven into the workpiece 50 with a hammer. The fixturing grip 52*a* "bites" into the workpiece 50 by means of the teeth, which act as short, broad nails. The fixturing grips 52*a* remain in place throughout the entire process of machining the workpiece 50, including flipping the workpiece 50 end over end in the device, if necessary, to accommodate workpiece 50 lengths greater than 9".

Figure 6:
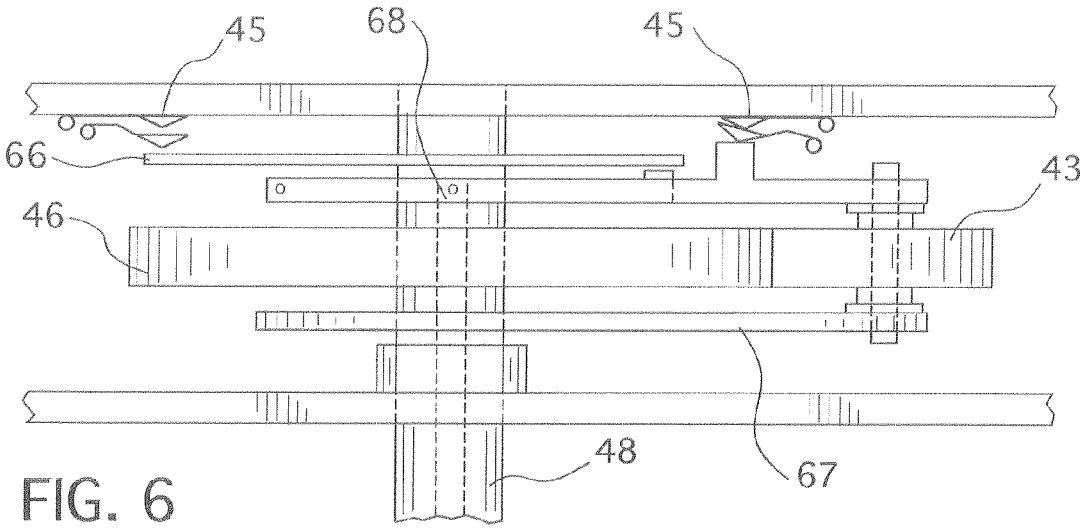
FIG. 6 shows a top plan view of the selector assembly.
Figure 6A:
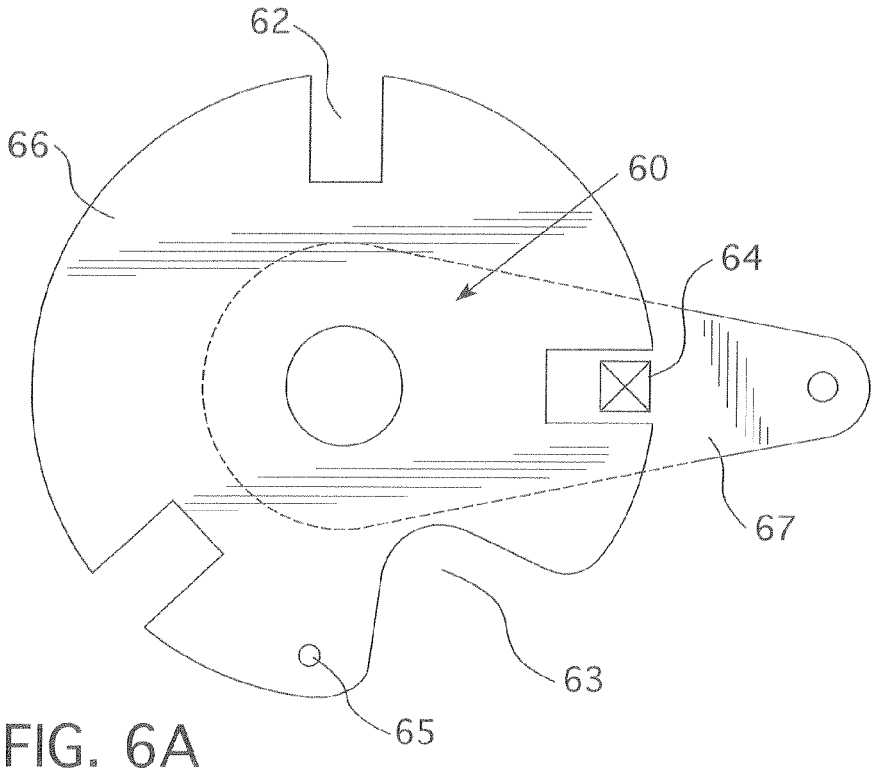
FIG. 6A shows a front view of the detent plate component of the selector assembly.
Figure 9:
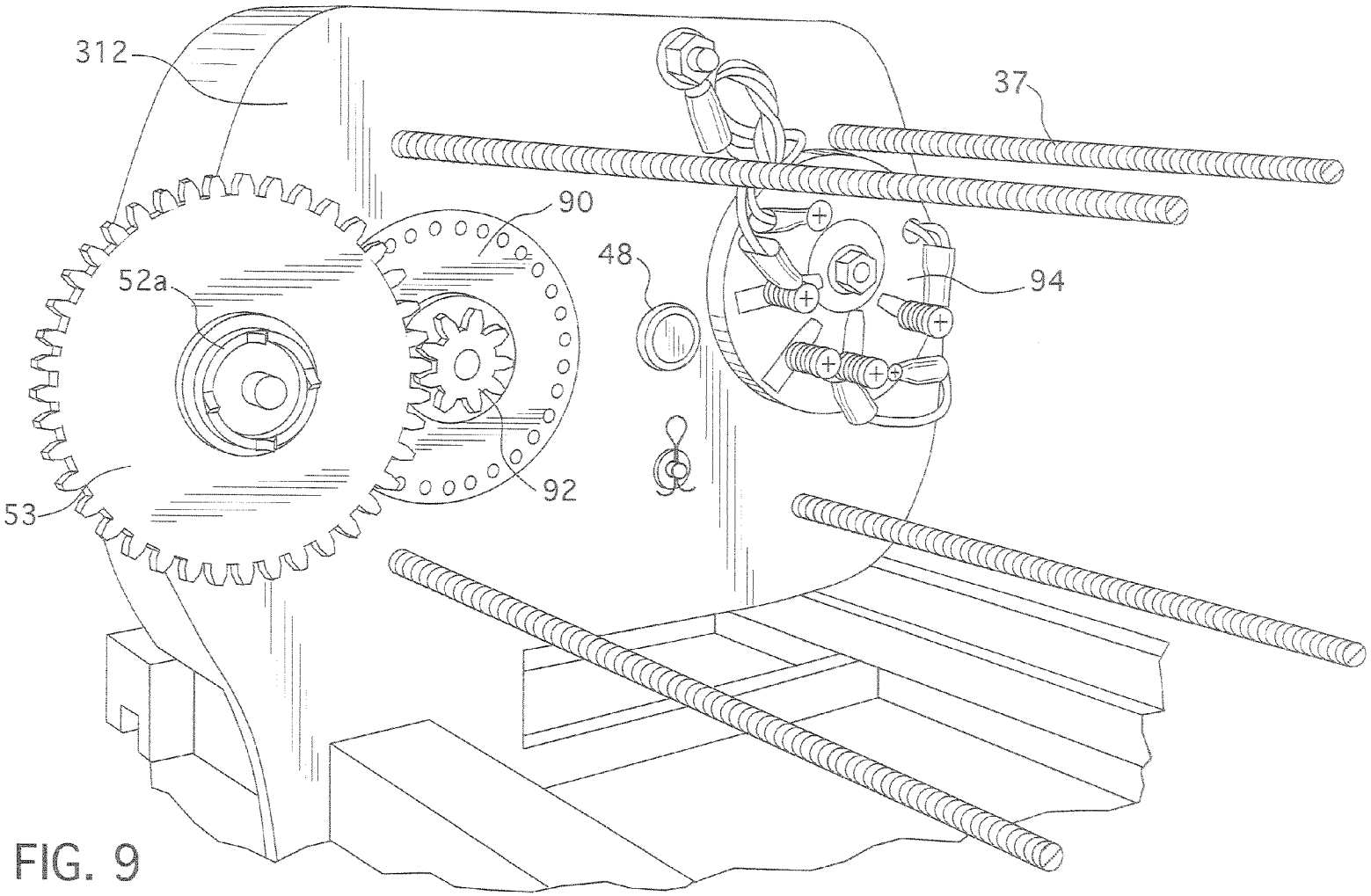
FIG. 9 shows a perspective view of the inner wall of the bulkhead subassembly.

Referencing now FIGS. 6 and 6A, a handle 61 (FIG. 3 only) on the right-hand side of the bulkhead subassembly 34 is connected to the selector shaft 48 and allows the operator to select one of three (3) positions, labeled "DRIVE," "INDEX," and "TURN." When the selector handle 61 is set to "DRIVE," power is transferred to the sprockets 40 and chain 42; when set to "TURN," power is transferred to the external pinion 92 (FIG. 9); and when set to "INDEX," the external pinion 92 is free to turn. The selector assembly 60 includes a bull gear 46 and a selector pinion 43 adjacent to the bull gear 46, the bull gear revolving about the selector shaft 48, which passes through and is supported by holes in the outside bulkhead wall 310 and the inside bulkhead, wall 312 (FIG. 3), the bull gear 46 engaged by the motor pinion 44 (FIG. 4), wherein a position of the selector assembly 60 determines whether the selector pinion 43 delivers power to the lower-left sprocket/gear (FIG. 4) or to the turning gear. The turning gear is connected by a shaft to the external pinion 92 (FIG. 9).

A spring-loaded detent plate 66 locks the selector assembly 60 into one of the above three positions. A button in the center of the handle 61 passes through a hole 41 and pushes the detent plate 66 away from the selector arm 67, allowing it to turn. Whenever the selector assembly 60 is in the DRIVE or TURN position, the corresponding electric contact 45 beneath it is closed. Each electric contact 45 plate consists of a spring-loaded lever that, when pushed by the square lug 64 closes an electrical switch. When the selector assembly 60 is in the DRIVE or TURN positions, the lug presses down on the end of the corresponding lever, which then presses down and closes the corresponding electrical contact 45. Therefore, the selector assembly 60 further comprises a bull gear 46 and the selector pinion 43 mounted between two selector arms 67. The square lug 64 is mounted on one of the selector arms 67. The detent plate 66 is held in a fixed orientation when assembled into the housing 300 of the bulkhead subassembly 34 by means of an immobilization pin (not shown) which passes through the immobilization pin hole 65 in the detent plate and corresponding small holes in the outside bulkhead wall 310 and the inside bulkhead wall 312. A spring-loaded rod 68 located within a hole 41 in the selector shaft allows the detent plate 66 to be pushed away from the square lug 64. The shaft 48 of the selector assembly 60 passes through and is supported by a hole in the outside of the bulkhead wall 310 and the inside bulkhead wall 312. It also serves as the axis for the bull gear 46. The selector pinion 43 is attached to the far end of the selector arm 67 and is continually engaged with the bull gear 46. The position of the selector assembly 60 thus determines where the power is transferred.

Figure 7A:
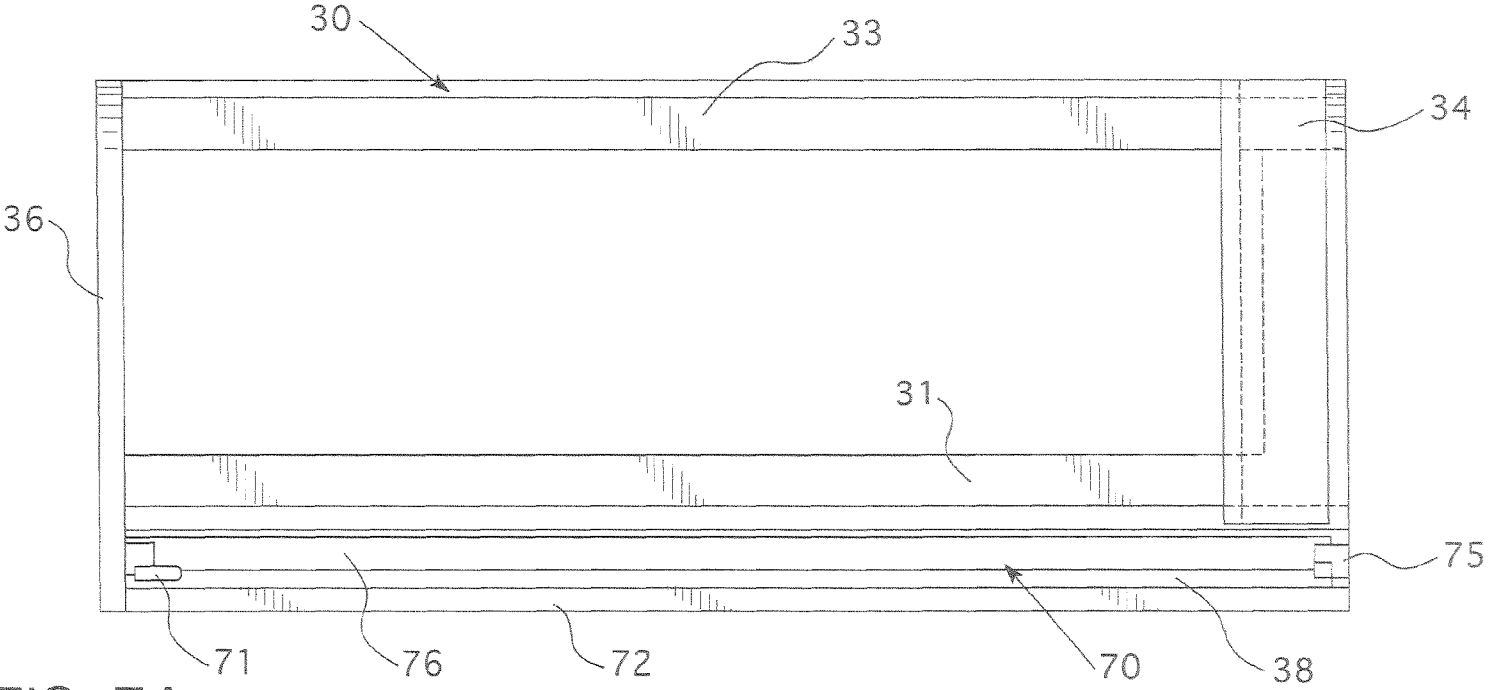
FIG. 7A shows atop plan view of the template holder.
Figure 7B:
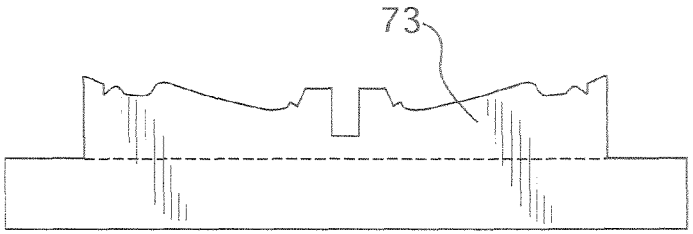
FIG. 7B is a side view of a template example.

FIG. 7A shows a top elevation view of the template holder assembly 70 and FIG. 7B is a side view of a template example. The template holder assembly 70 is a narrow, elevated template platform 38, a back wall, and an elongate clamp rail 76 to hold the template 73 in place. The elongate clamp rail 76 is manipulated by way of clamp handle 71 and is spring loaded to permit templates to be rapidly installed, removed, or reversed. The template holder assembly 70 can accommodate templates up to 18" in length. If the template is longer than 9", the operator can flip the template in tandem with the workpiece 50 end-for-end. To facilitate this process, it may be convenient to use a registration mark on the template, and transfer this marking to the workpiece 50, where it can be trimmed away after the workpiece 50 has been removed from the device. Structurally, the template holder assembly 70 for securing a template 73 for the workpiece 50 comprises the template platform 38 and a high surface 72 forming a back stop for the template 73; and, an elongate clamp rail 76 above the platform pivotable downward about a pair of pivots 75 to engage the template 73 and secure the template 73 between the template platform 38 and the elongate clamp rail 76.

For preparing the template 73, the template 73 is a pattern made from a thin, durable, precision-machinable material, that serves to guide the location of the carriage relative to the band saw blade 14*a*, by means of its interaction with the stylus 15. Templates can be made of hard wood or plastic (⅛" thick), or metal (typically 1/32" to 1/16" thick). Templates may be provided already made, or custom made by the operator from template blanks. Examples of ready-made templates might include: uniform-width templates of various widths, for making dowel rods; tapered templates, for making pegs; templates for turning and/or indexing decorative posts; etc.

To custom make a template, the operator begins with a suitable blank, such as a ⅛"-thick piece of hardwood, and uses a saw and/or file to cut out the desired pattern. The portion of the template closest to the back of the template holder needs to include a fixed allowance (typically ½") for the portion that lies on top of the template platform 38 and to provide rigidity to those portions where the workpiece 50 is turned to a narrow diameter. For templates that include pieces that will be separated from one another, the template should include physical markings (notches, steps, etc.) to indicate where the pieces, are to be separated after removal of the workpiece 50 from the device. A single template can include multiple patterns of the same or different items, if desired.

Figure 8:
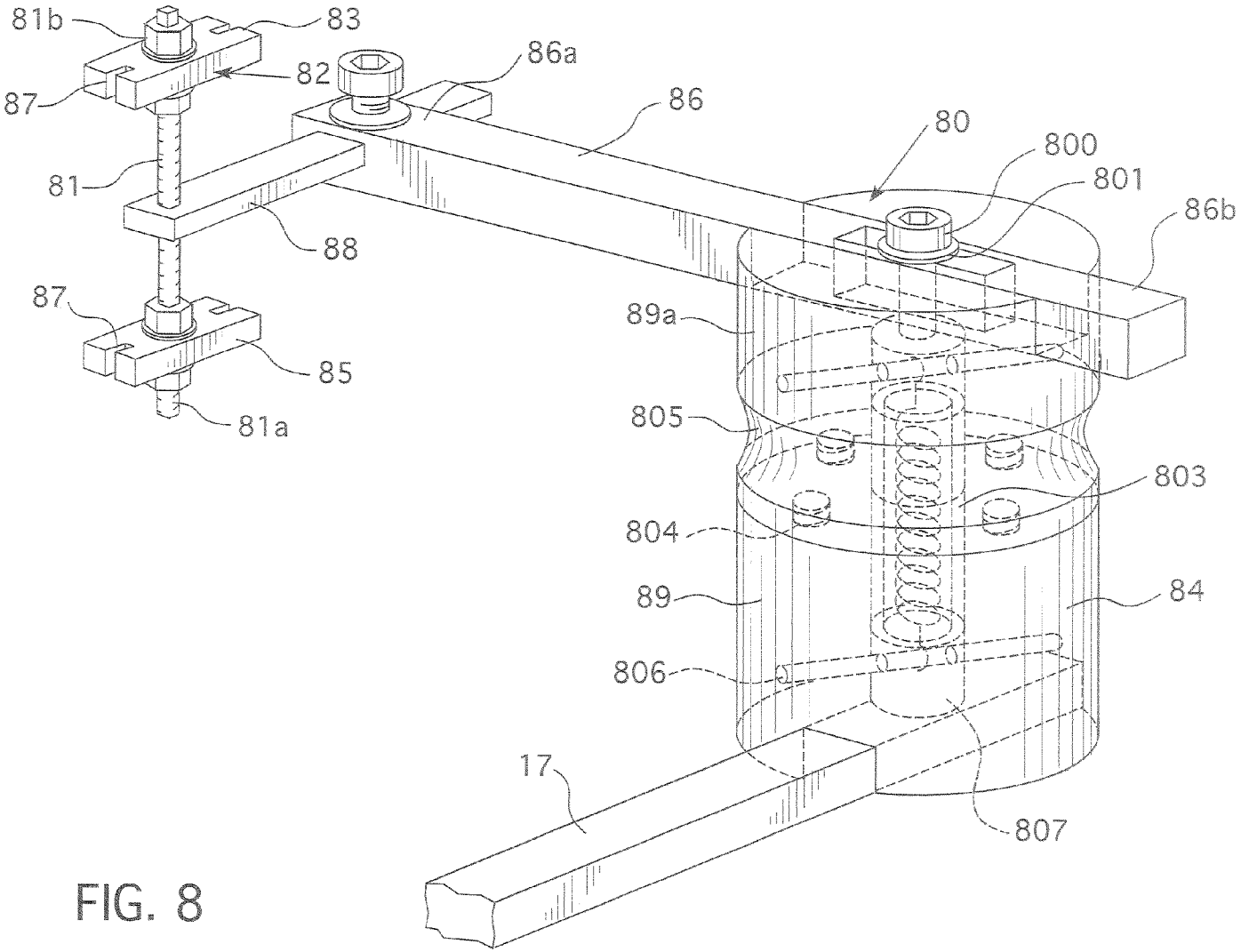
FIG. 8 shows a perspective view of the blade guide subassembly.

Now with reference to FIG. 8, shown is a perspective view of the band saw guide assembly 80. Band saw guide assembly 80 resides on the ridge 17 of the foundation assembly 10, the band saw guide assembly 80 further comprising a blade guide subassembly 82 and a guide tower subassembly 84. The blade guide subassembly 82 includes a main guide bar 86 having a distal end 86*a* and a proximal end 86*b* and a secondary guide bar 88 connected to the distal end 86*a*. A vertical guide bar 81 is disposed through the secondary guide bar 88, the vertical guide bar 81 having a lower end 81*a* and an upper end 81*b*. An upper guide 83 is situated at the upper end 81*b*, and a lower guide 85 is situated at the lower end 81*a*, each the upper guide 83 and the lower guide 85 having blade slots 87 defined therein for receiving a back of the blade 14*a* of the band saw 14. It is important that the band saw blade 14*a* make contact with the workpiece 50 at a fixed point as projected onto the plane of the table 12. Although most band saws have an upper band saw blade guide for this purpose (as well as for safety reasons), this must be raised to at least 6.75" to allow free movement of the carriage beneath it. To keep the band saw blade 14*a* from vibrating under these conditions, the device includes this band saw blade guide subassembly 82, which is connected to the foundation ridge 17 by means of a guide tower subassembly 84 and guide bars 81, 88, and 86.

As above, band saw blade guides 83, 85 are positioned above and below the elevation of the axis of rotation of the workpiece 50, to stabilize the band saw blade 14*a* while making precise cuts into the workpiece 50. Each band saw blade guide 83, 85 consists of a material having a low coefficient of friction (against the steel band saw blade 14*a*) and resistance to elevated temperature, such as brass. Each guide contains a thin, vertical blade slot 87 to accommodate the back of the band saw blade 14*a*, i.e., the portion of the band saw blade 14*a* without the teeth. Since they will eventually wear out, the guides 83, 85 are replaceable. The life of each guide 83, 85 can be doubled by making it reversible, as shown.

The guide tower subassembly 84 further includes a lower half 89 engaged with the ridge 17 and an upper half 89*a* connected to the lower half 89 and to the proximal end 86*b* of the main guide bar 86. Included is a means for rotating the upper half 89*a* about the lower half 89 wherein the blade guide subassembly 82 can be maneuvered. The guide tower subassembly 84 is a large cylindrical post which is mounted to the end of the foundation ridge 17 extension. The top half of the tower can be lifted and turned, to swing the blade guides 83, 85 away from the blade 14*a* for easy removal of the device from the band saw table 12. Pegs and holes 804 within the tower ensure that the guide consistently returns to the same position. A hollow axle helps maintain alignment during this process, and a spring within the axle holds the two halves firmly together.

A slot in the top of the upper half 89*a* of the tower accommodates the main guide bar 86, which preferably is a ½" hollow square tube, held in place by means of an allen screw 800 and split washer 801. A slot in the main guide bar 86 allows horizontal alignment of the band saw blade guides 83, 85 with the band saw blade 14*a*. A square or rectangular hole in the distal end 86*a* of the main guide bar 86 accommodates the secondary guide bar 88, which preferably is a ¼" square bar, also held in place with an allen screw for forward/backward adjustment, in the preferred embodiment the vertical guide bar 81 is a 3/16" square bar that has received a ¼"-20 external thread and is brazed to the end of the secondary guide bar 88. The guides 83, 85 include 3/16" square holes (to prevent rotation) and are held in place with nuts and washers.

With reference to FIG. 9 and with continued reference to FIG. 5, shown is a perspective view of the inner wall of the bulkhead subassembly 34. The purpose herein is to show the indexing mechanism which is a means for rotating the workpiece 50 in increments. The external pinion 92 protrudes a short distance (~¼") away from the left side of the bulkhead, i.e., into the workspace 314 between the bulkhead subassembly 34 and the endwall 36. When the fixturing grip 52*a* at one end of the workpiece 50 is inserted into the fixturing bearing 52, the removable gear 53 is first placed over the hexagonal nut region of the fixturing grip 52*a*. The removable gear 53 thus engages both the fixturing grip 52*a* and the external pinion 92. Preferably, the removable gear 53 is four times (4×) the diameter of the external pinion 92.

In indexing, the workpiece 50 is machined in a similar manner as in turning, except that it is held at a fixed angle about its axis of rotation by means of an indexing wheel 90 and pin. Once the workpiece 50 has been machined along one face, the workpiece 50 is indexed at another angle and the process is repeated. This method produces non-circular cross sections that are either uniform along the axial direction (e.g., triangular or octagonal prisms), or that vary along the axis (such as a shaped chair leg square in cross section). Pieces having cross sections that are not rotationally symmetric can be produced by using multiple templates, each for use with a specific index angle. For example, one template for the front and back views (0° and 180°) and one template for the side views (90° and 270°) can be used to produce the starting point for carving wooden figures, such as knights for a chess set. Using templates for more than 4 index angles can be used to produce higher three-dimensional detail, such as a bust of a famous composer. The external pinion 92 also has an index wheel 90 with thirty (30) evenly-spaced holes. An index pin can be inserted through the bulkhead (i.e., from the right-hand side of the bulkhead) and into one of these index holes. (The index pin is stowed in a clip on the right side of the bulkhead when not in use.) For convenience, the holes are numbered as follows: A0, B0, C0, A1, B1, C1, . . . , A9, B9, C9. The following table 1 can be used to rotate the workpiece 50 in N even increments. When using this table, it is important that the index wheel 90 is always turned in the direction of increasing hole number:

TABLE 1

| No. of Facets, N | Increment Angle | Index Holes (in Increasing Order) |
|---|---|---|
| 3 | 120° | A0; one whole turn, then B3; one whole turn, then C6 |
| 4 | 90° | A0, A0, A0, A0 |
| 5 | 72° | A0, A8, A6, A4, A2 |
| 6 | 60° | A0, C6, B3, A0, C6, B3 |
| 8 | 45° | A0, A5, A0, A5, A0, A5, A0, A5 |
| 10 | 36° | A0, A4, A8, A2, A6, A0, A4, A8, A2, A6 |
| 12 | 30° | A0, B3, C6, A0, B3, C6, A0, B3, C6, A0, B3, C6 |
| 15 | 24° | A0, C2, B5, A8, C0, B3, A6, C8, B1, A4, C6, B9, A2, C4, B7 |
| 20 | 18° | A0, A2, A4, A6, A8, A0, A2, A4, A6, A8, A0, A2, A4, A6, A8, A0, A2, A4, A6, A8 |
| 24 | 15° | A0, C1, B3, A5, C6, B8, A0, C1, B3, A5, C6, B8, A0, C1, B3, A5, C6, B8, A0, C1, B3, A5, C6, B8 |
| 30 | 12° | A0, B1, C2, A4, B5, C6, A8, B9, C0, A2, B3, C4, A6, B7, C8, A0, B1, C2, A4, B5, C6, A8, B9, C0, A2, B3, C4, A6, B7, C8 |
| 40 | 9° | A0, A1, A2, A3, A4, A5, A6, A7, A8, A9, A0, A1, A2, A3, A4, A5, A6, A7, A8, A9, A0, A1, A2, A3, A4, A5, A6, A7, A8, A9, A0, A1, A2, A3, A4, A5, A6, A7, A8, A9 |
| 60 | 6° | A0, C0, B1, A2, C2, B3, A4, C4, B5, A6, C6, B7, A8, C8, B9, A0, C0, B1, A2, C2, B3, A4, C4, B5, A6, C6, B7, A8, C8, B9, A0, C0, B1, A2, C2, B3, A4, C4, B5, A6, C6, B7, A8, C8, B9, A0, C0, B1, A2, C2, B3, A4, C4, B5, A6, C6, B7, A8, C8, B9 |

Using a removable gear 53 between the external pinion 92 and the fixturing grip 52*a* enables the workpiece 50 to be reversed end-to-end within the carriage, without detaching the grips from the workpiece 50.

Figure 10:
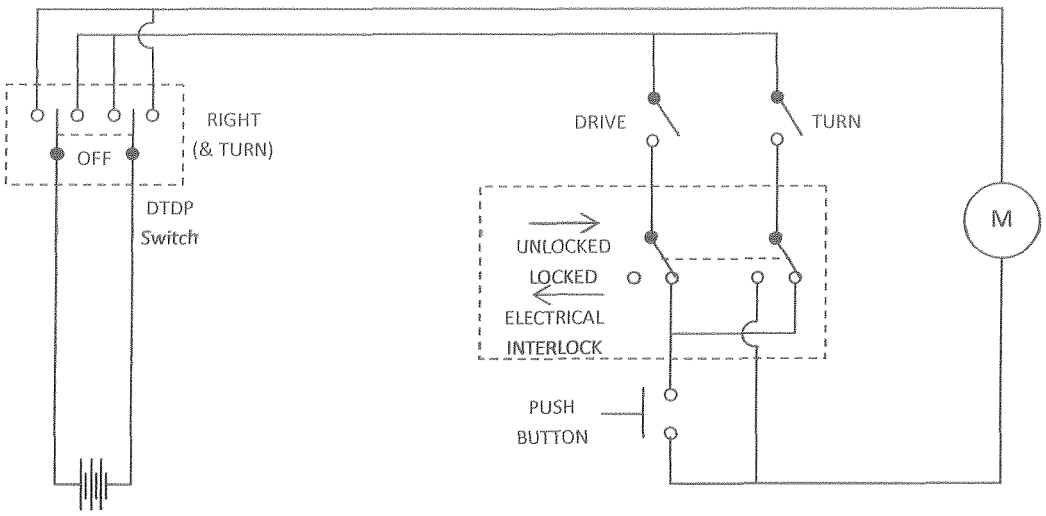
FIG. 10 is a circuit diagram for the electrical interlock.

With reference to FIG. 10 and with continued reference to FIG. 6, electrical contacts 45 within the selector assembly 60 and electromechanical interlock 94 mechanism only permit operation, of the motor 318 when the device is properly configured, to avoid unintended operation and possible damage to the device. (For example, the bulkhead cannot be driven if the sprockets 40 are locked, and the workpiece 50 cannot be turned continuously unless the sprockets 40 are locked.) The wiring diagram for the electro-mechanical interlock 94 is shown in FIG. 10. Note #1: Both the "DRIVE" and "TURN" contacts are open when the selector is set to "INDEX." Note #2: The electrical portion of the electromechanical interlock 94 on the device as shown is located on the left wall of the bulkhead but a customized switch can be made small enough to fit within the bulkhead housing 300.

I claim:

1. A lathe accessory for a band saw, comprising:

a foundation assembly adapted to attach to a table for said band saw, said foundation assembly having a pair of long edges with one of said long edges configured to overhang said table and bottom surface;

a translating layer assembly engaging said foundation assembly, said translating layer assembly having a top, an underside, a left half, and a right half;

a carriage assembly disposed on said translating layer, said carriage assembly further comprising a frame subassembly and a bulkhead subassembly; said frame subassembly further comprising an end wall and multiple threaded rods rigidly attached to said endwall extending the length of said frame subassembly traveling through said bulkhead subassembly;

said bulkhead subassembly has a bulkhead bottom conforming to said frame leg, a housing, an outside bulkhead wall, and an inside bulkhead wall, thereby defining a workspace between said endwall and said bulkhead subassembly;

a template holder assembly for securing a template for a workpiece within said workspace; and, a bandsaw guide assembly on said foundation assembly, said bandsaw guide assembly further comprising a blade guide subassembly and a guide tower subassembly for maneuvering a blade of said band saw.

2. The lathe accessory of claim 1, wherein said foundation assembly further comprises:

a pair of foundation rails inward from said long edges and traveling a length of said foundation assembly;

a stylus base disposed on said bottom surface;

a stylus attached to said stylus base upstanding therefrom; and a ridge on said bottom surface extending downward therefrom, said ridge configured to fit into a tool guide groove of said, band saw table.

3. The lathe accessory of claim 2, wherein said translating layer assembly further comprises:

a pair of grooves defined within said underside, each said groove shaped to mate with a respective one of said foundation, rails;

a pair of translating rails on said top; and, a slot defined within said left half permitting movement of said translating layer without interference with said stylus.

4. The lathe accessory of claim 1, wherein said frame subassembly further comprises:

said endwall adapted to support a left end of a workpiece;

a template platform extending from said endwall;

a front frame rail extending from said endwall spaced from said template platform defined over said slot;

a back frame rail extending from said, endwall opposite both said template platform, and said front frame rail; and, a frame leg perpendicular to said back frame rail opposite said endwall connecting said front frame rail and said back frame rail and slidably disposed over one of said translating rails, wherein said front frame rail and said back frame rail are both connected to said frame leg to thereby slidably connect said frame subassembly to said translating layer.

5. The lathe accessory of claim 1, wherein said bulkhead subassembly further comprises:

a notch defined at a bulkhead, bottom fitting over said front frame rail;

multiple sprockets disposed within a housing thereof, each said sprocket having a center through which each said threaded, rod passes;

a chain within said housing engaging and synchronizing each said sprocket; and, a motor mounted on an outside bulkhead wall for turning said sprockets.

6. The lathe accessory of claim 5, further comprising a selector assembly within said bulkhead subassembly including a bull gear and a selector pinion adjacent to said bull gear, said bull gear including a shaft passing through, and supported by a hole in each said outside bulkhead wall and an inside bulkhead wall, said, bull gear engaged by a motor pinion of said motor, wherein a position of said selector assembly determines whether said selector pinion delivers power to said chain or to said motor pinion.

7. A lathe accessory for a band saw, comprising:

a foundation assembly adapted to attach to a table for said band saw, said foundation assembly having a pair of long edges with one of said long edges configured to overhang said table and bottom surface, and further comprising:

a pair of foundation, rails inward from said long edges and traveling a length of said foundation assembly;

a stylus base disposed on said bottom surface;

a stylus attached to said stylus base upstanding therefrom;

a ridge on said bottom surface extending downward therefrom, said ridge configured to fit into a tool guide groove of said band saw table;

a translating layer assembly engaging said foundation, assembly, said translating layer assembly having a top, an underside, a left half, and a right half, and further comprising:

a pair of grooves defined, within, said underside, each said groove shaped to mate with a respective one of said foundation rails;

a pair of translating rails on said top;

a slot defined within said left half permitting movement of said translating layer without interference with said stylus;

a carriage assembly disposed, on said translating layer, said carriage assembly further comprising a frame subassembly and a bulkhead subassembly, said frame subassembly further comprising:

an endwall adapted to support a left end of a workpiece;

a template platform, extending from, said endwall;

a front frame rail extending from said endwall spaced from said template platform defined over said slot;

a back frame rail extending from said endwall opposite both said, template platform and said front frame rail;

a frame leg perpendicular to said back frame rail opposite said endwall connecting said front frame rail and said back frame rail and slidably disposed over one of said translating rails, wherein said front frame rail and said back frame rail are both connected to said frame leg to thereby slidably connect said frame subassembly to said translating layer; and, multiple threaded rods rigidly attached to said endwall extending the length, of said frame subassembly traveling through said bulkhead subassembly.

8. The lathe accessory of claim 7, wherein said bulkhead subassembly has a bulkhead bottom conforming to said frame leg, a housing, an outside bulkhead wall, and an inside bulkhead wall, thereby defining a workspace between said endwall and said bulkhead subassembly, said bulkhead subassembly further comprising:

a notch defined at said bulkhead bottom fitting over said front frame rail;

multiple sprockets disposed within said housing, each said sprocket having a center through which each said rod passes;

a chain within said housing engaging and synchronizing each said sprocket;

a motor mounted on said outside bulkhead wall for turning said sprockets, said motor including a motor pinion housed within said, housing; and, a selector assembly including a bull gear and a selector pinion adjacent to said bull gear, said bull gear including a shaft passing through and supported by a hole in each said outside bulkhead wall and said inside bulkhead wall, said bull gear engaged by said motor pinion, wherein a position of said selector assembly determines whether said selector pinion delivers power to said chain or to said motor pinion.

9. The lathe accessory of claim 7, further comprising a template holder assembly for securing a template for said workpiece, said template holder assembly further comprising:

said template platform forming a platform for said template; and, an elongate clamp rail above said platform pivotable downward about a pair of pivots to engage said template and secure said template between said template platform and said elongate clamp rail.

10. The lathe accessory of claim 7, further comprising a bandsaw guide assembly on said ridge of said foundation assembly, said bandsaw guide assembly further comprising a blade guide subassembly and a guide tower subassembly, said blade guide subassembly further comprising:

a main guide bar having a distal end and a proximal end;

a secondary guide bar connected to said distal end;

a vertical guide bar through said secondary guide bar, said vertical guide bar having a lower end and an upper end; and, an upper guide at said upper end and a lower guide at said lower end, each said upper guide and said lower guide having blade slots defined therein for receiving a back of a blade of said band saw.

11. The lathe accessory of claim 10, wherein said guide tower subassembly further comprises:

a lower half engaged with said ridge;

an upper half connected to said lower half and to said proximal end of said main guide bar; and, a means for rotating said upper half about said lower half wherein said blade guide subassembly can be maneuvered.

12. The lathe accessory of claim 7, further comprising a means to clamp said foundation assembly to said bandsaw table.

13. The lathe accessory of claim 9, wherein said stylus has a front edge of small radius to follow a pattern of said template.

14. The lathe accessory of claim 8, wherein said selector assembly further comprises:

said bull gear and said pinion mounted between two selector arms;

a square lug at the end of one of said selector arms;

a detent plate that is held in a fixed orientation when assembled into the housing of said bulkhead assembly; and, a spring-loaded rod allowing the detent plate to be pushed away from said square lug.

15. The lathe accessory of claim 7, further comprising a means for securing said workpiece within said workspace.

16. The lathe accessory of claim 8, further comprising a means for rotating said workpiece within said workspace.

17. The lathe accessory of claim 16, further comprising a means for rotating said workpiece manually and in even increments.

18. The lathe accessory of claim 8, further comprising a means for limiting a proximity of said bulkhead assembly with said endwall of said frame subassembly.

19. The lathe accessory of claim 7, further comprising an electro-mechanical interlock means for locking and unlocking said lathe accessory and prohibiting unintended use.

20. The lathe accessory of claim 8, further comprising a means for varying a position of said selector assembly to vary a mode of operation of said lathe accessory.

* * * * *